US007137825B2

(12) United States Patent
Myer et al.

(10) Patent No.: US 7,137,825 B2
(45) Date of Patent: Nov. 21, 2006

(54) SHIELDED ELECTRICAL JACK CONNECTOR

(75) Inventors: John M Myer, Millersville, PA (US); Douglas J Hardy, Middletown, PA (US); Kellie Coble, Archdale, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/814,322

(22) Filed: Mar. 31, 2004

(65) Prior Publication Data

US 2005/0221673 A1 Oct. 6, 2005

(51) Int. Cl.
*H01R 12/00* (2006.01)

(52) U.S. Cl. ..... 439/63; 439/579

(58) Field of Classification Search ..... 439/63 I, 439/579 X, 581, 607
See application file for complete search history.

(56) References Cited

U.S. PATENT DOCUMENTS 5,011,415 A * 4/1991 Suzuki et al. ..... 439/63
5,334,050 A 8/1994 Andrews
5,613,880 A * 3/1997 Wang ..... 439/620
5,645,454 A * 7/1997 Kosmala ..... 439/675
6,386,888 B1 * 5/2002 Skopic et al. ..... 439/63
6,530,787 B1 * 3/2003 Harting et al. ..... 439/83
6,575,761 B1 * 6/2003 Regnier ..... 439/63
6,676,443 B1 * 1/2004 Wang ..... 439/541.5
6,776,621 B1 * 8/2004 Dye ..... 439/63
6,932,614 B1 * 8/2005 Kan ..... 439/580

* cited by examiner

*Primary Examiner*—Thanh-Tam Le

(57) ABSTRACT

A shielded jack assembly is shown having a front cylindrical tube, and a rear ground shell portion. The rear ground shell is stamped and formed from pre-plated metal, and includes a partial cylindrical portion, plate portions extending downwardly therefrom, and printed circuit board portions depending from the plate portions. A rear wall portion is integral with the partial cylindrical portion, and depends therefrom via a hinge. The rear wall portion is bent to cover the end opening in the partial cylindrical portion.

18 Claims, 7 Drawing Sheets

SHIELDED ELECTRICAL JACK CONNECTOR

BACKGROUND OF THE INVENTION

The subject invention relates to shielded jacks, and more particularly to a stamped and formed jack for mounting on a printed circuit board.

It is common to provide a shielded cable connection to a printed circuit board. Normally these connectors have a pin terminal configured in a right-angle configuration, where a right-angle portion is provided for connection to a printed circuit board. The pin is insulated within a conductive outer shell, where the shell typically comprises a drawn tube of metal, where the drawn tube is plated after the drawing process. The metal from which the tube is drawn cannot be pre-plated, because the drawing process would damage the plating providing ineffective shielding and grounding qualities. The combination of the drawing process and post-plating is an expensive cost adder in the manufacturing process for electrical connectors, and therefore it would be desirable to eliminate this step.

It would be advantageous to provide a right-angle shielded jack assembly, where at least a portion of the grounding shell is stamped and formed from pre-plated metals to lower the expense of the manufacturing process.

One application of a stamped and formed right-angle connector is shown in GB Patent Application Publication Number 2 248 730 A, where two stamped and formed ground shells encapsulate a pin terminal and an insulator therein, which provides a board mountable connector. This connector, however, provides longitudinal seams in the ground shell along its entire length.

SUMMARY OF THE INVENTION

The objects of the invention have been accomplished by providing a shielded jack assembly, comprising an elongate insulator member having a central elongate pin receiving passageway, and a rear slot intersecting the passageway at least to an outer surface of the insulator member, and a recess portion adjacent a front end of the insulator. An electrical pin is provided, having an elongate portion positioned insulatively in the passageway, and having an orthogonally arranged printed circuit board tine, which extends in the rear slot portion and extends downwardly beyond the outer surface of the insulator, and the pin has a mating portion extending into the recess portion such that the pin is exposed. An elongate seamless shielded tube extends from a position adjacent the front end of the insulator, and rearwardly, at least partially along the length of the insulator member. A stamped and formed metallic ground shell has an outer body portion conforming to an exterior contour of the shielded tube, sidewall portions extending downwardly therefrom with integrally formed printed circuit board portions, and a rear plate portion hingedly connected to the outer body portion, and folded downwardly to enclose an end opening.

The insulator member, shielded tube, and the outer body portion of the ground shell are cylindrical in cross section. The shielded tube and the ground shell are fixed together along their length. The shielded tube includes a peripheral undercut and the ground shell is crimped around the tube with a section of the outer body portion extending into the undercut.

The shielded jack assembly further comprises an outer shroud portion surrounding the shielded tube, forming an outer shielding. The outer shroud portion is stamped and formed to define a longitudinal overlapping seam. The shielded jack assembly may comprise a plurality of assembled insulator members, pins, shielded tubes, and ground shells, the shroud including a rear wall having a like plurality of openings therethrough for receiving the plurality of assembled insulator members, pins, shielded tubes, and ground shells. The overlapping seam extends downwardly and inwardly, extending intermediate the plurality of assembled insulator members, pins, shielded tubes, and ground shells, and defines an alignment rib for a mating connector. The rear plate of the ground shell and the outer shroud member have a tab extending downwardly therefrom profiled for soldering to a printed circuit board.

In another aspect of the invention, an inventive shielded jack assembly comprises an elongate cylindrical insulator member having a central elongate pin receiving passageway, and a rear slot intersecting the passageway at least to an outer surface of the insulator member, and a recess portion adjacent a front end of the insulator. An electrical pin, has an elongate portion positioned insulatively in the passageway, and has an orthogonally arranged printed circuit board tine, which extends in the rear slot portion and extends downwardly beyond the outer surface of the insulator, and the pin has a mating portion extending into the recess portion, where the pin is exposed. An elongate cylindrical seamless shielded tube extends from a position adjacent the front end of the insulator, and rearwardly, at least partially along the length of the insulator member. A stamped and formed metallic ground shell has an outer body portion conforming to, and crimped to, an exterior contour of the shielded tube. Sidewall portions extend downwardly from the metallic ground shell with integrally formed printed circuit board portions. An outer shroud portion surrounds the shielded tube, forming an outer shielding.

The shielded jack further comprises a rear plate portion hingedly connected to the outer body portion, and folded downwardly to enclose an end opening. The tube includes a peripheral undercut and the ground shell is crimped around the tube with a section of the outer body portion extending into the undercut. The outer shroud portion is stamped and formed to define a longitudinal overlapping seam. The shielded jack assembly comprises a plurality of assembled insulator members, pins, shielded tubes, and ground shells, the shroud including a rear wall having a like plurality of openings therethrough for receiving the plurality of assembled insulator members, pins, shielded tubes, and ground shells. The overlapping seam extends downwardly and inwardly, and intermediate the plurality of assembled insulator members, pins, shielded tubes, and ground shells, and defines an alignment rib for a mating connector. The rear plate of the ground shell and the outer shroud member has a tab extending downwardly therefrom profiled for soldering to a printed circuit board.

An inventive method of forming a shielded jack assembly, comprises the steps of providing an elongate insulator member having a central elongate pin receiving passageway, and a rear slot intersecting the passageway at least to an outer surface of the insulator member, and a recess portion adjacent a front end of the insulator. The method further includes providing an electrical pin, with an elongate portion, and forming an orthogonally arranged printed circuit board tine; inserting the pin into the insulator member such that the elongate portion is positioned insulatively in the passageway, and such that the printed circuit board tine extends in the rear slot portion and extends downwardly beyond the outer surface of the insulator, and the pin having a mating portion extending into the recess portion, where the pin is exposed; providing an elongate seamless shielded tube extending from a position adjacent the front end of the insulator, and rearwardly, at least partially along the length of the insulator member, and stamping and forming a metallic ground shell to comprise an outer body portion conforming to an exterior contour of the shielded tube, sidewall portions extending downwardly therefrom with integrally formed printed circuit board portions, and a rear plate portion hingedly connected to the outer body portion, and folding the rear plate portion downwardly to enclose an end opening.

The method further comprises the step of stamping and forming an outer shroud portion, placing the outer shroud portion in a surrounding relation with the shielded tube, and fixing the outer shroud portion and shielded tube together. The shielded tube is provided with a peripheral undercut and the ground shell is crimped around the tube with a section of the outer body portion extending into the undercut. The assembly further comprises the step of providing a plurality of assembled insulator members, pins, shielded tubes, and ground shells, with the shroud including a rear wall having a like plurality of openings therethrough for receiving the plurality of assembled insulator members, pins, shielded tubes, and ground shells.

DETAILED DESCRIPTION OF THE PREFERRED EMBODIMENT

Figure 1:
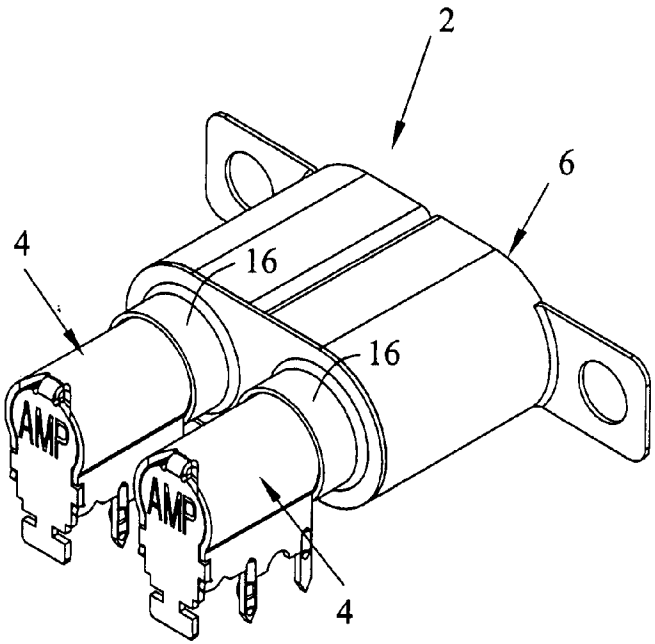
FIG. 1 shows a rear perspective view of the shielded jack assembly of the subject invention.
Figure 2:
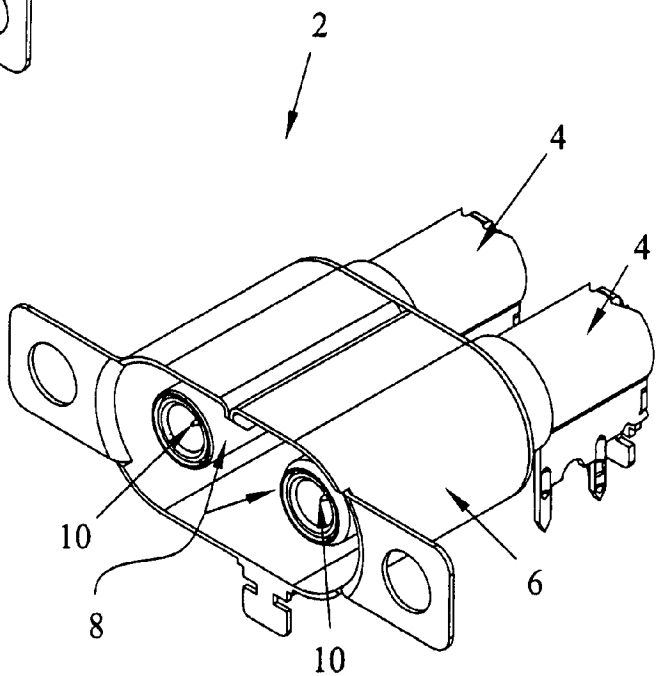
FIG. 2 shows a front perspective of the jack assembly of FIG. 1.
Figure 3:
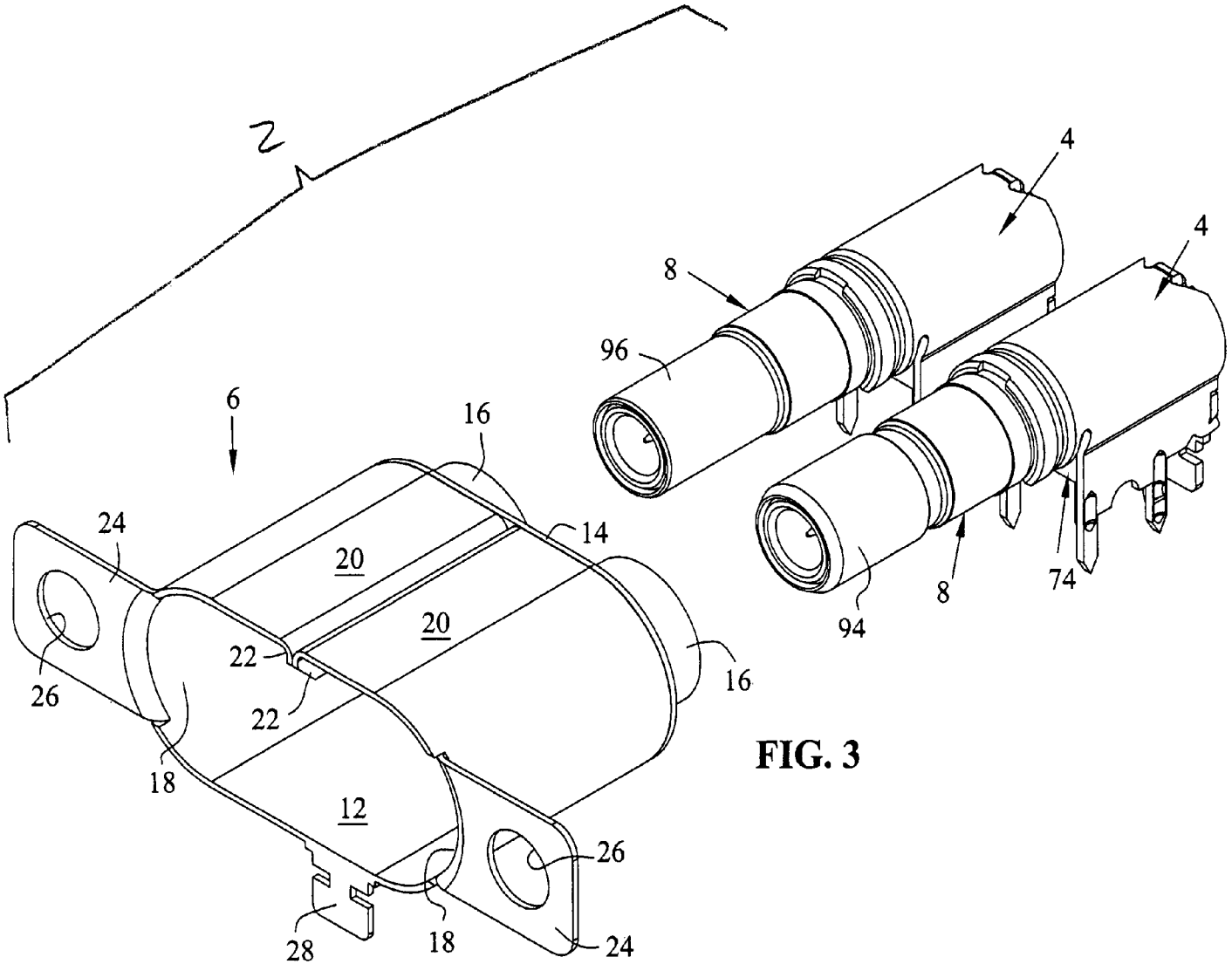
FIG. 3 shows a view similar to that of FIG. 2 showing the shielded shroud exploded away from the ground shell.

With respect first to FIGS. 1 and 2, the present invention relates to a jack assembly 2 shown best in FIGS. 1 and 2, which comprises a ground shell member 4, a front shielding shroud 6, cylindrical tubes 8, and pin terminals 10. With reference now to FIG. 3, the outer shroud 6 will be described in greater detail.

Shroud 6 is stamped and formed from a single sheet of material, where the original sheet is in the plane of lower wall 12. Lower wall 12 is continuous with an end wall 14, which includes drawn openings at 16. Radiused side walls 18 also extend from side edges of lower wall 12 and are reversely bent to form a split upper wall having wall halves 20. Each wall 20 has a seam 22 folded back upon itself so as to form a closed seam. Mounting ears 24 extend from opposite sides of radiused wall sections 18 and include mounting apertures at 26 for mounting to a shielded wall or a bulkhead, as will be described further herein. Finally, a grounding and mounting tab 28 extends from a leading edge of lower wall portion 12 and is profiled for mounting, as will also be described further herein.

Figure 4:
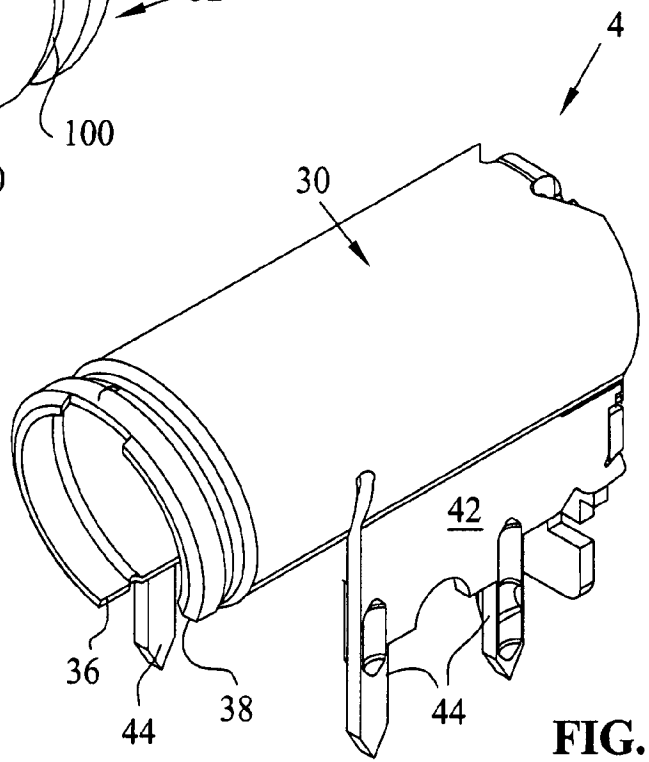
FIG. 4 shows a front perspective of the ground shell, as shown in FIG. 3.
Figure 5:
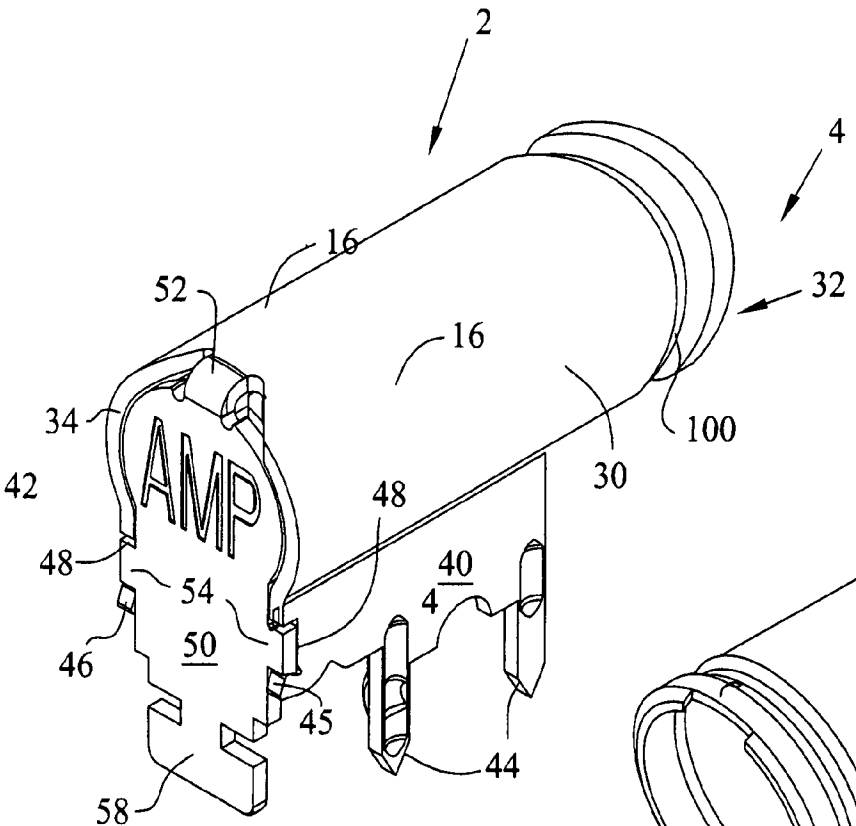
FIG. 5 shows a rear perspective view of the ground shell similar to that shown in FIG. 1.
Figure 6:
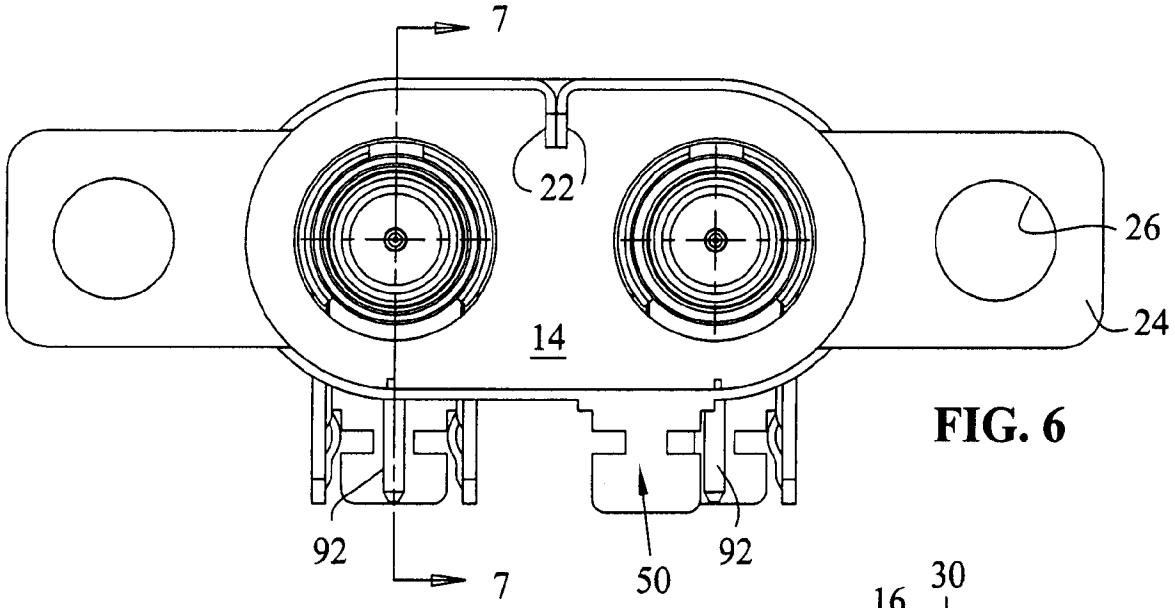
FIG. 6 is a front plan view of the assembled jack assembly.

With reference now to FIGS. 4 and 5, the ground shell 4 will be described in greater detail. As shown best in FIG. 5, ground shell 4 includes a partial cylindrical portion 30 having a front edge 32 and a rear edge 34. The partial cylindrical portion 30 terminates at edges 36, 38 (FIG. 4) and continues on with plate sections 40 and 42. Plate sections 40 and 42 include printed circuit board tine portions 44 extending therefrom profiled for receipt in printed circuit board throughholes, as is known in the art. As shown in FIG. 5, side wall 40 has an end edge 45, side wall 42 has an end edge 46, where each edge 45, 46 includes a recess 48. As also shown in FIG. 5, ground shell 4 includes a rear wall 50 hingedly attached at 52 to cylindrical portion 30. Rear wall 50 also includes locking tabs 54 profiled to be received in recesses 48. Finally, rear wall 50 includes mounting tab 58 extending downwardly from rear wall 50 and similarly configured as locking tab 28 (FIG. 3). It is also anticipated that the ground shell 4 is stamped and formed from a pre-plated steel plate.

Figure 7:
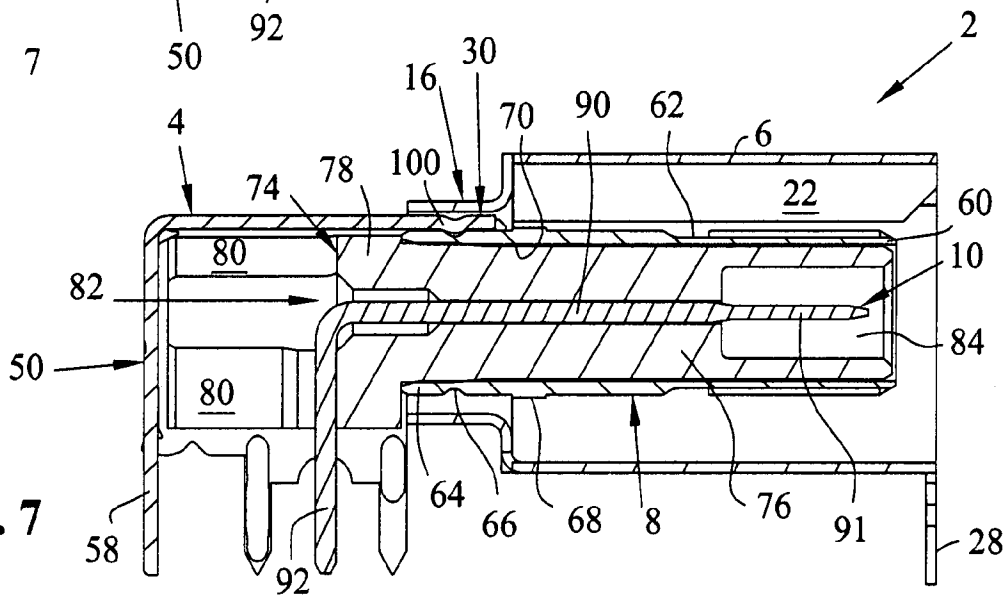
FIG. 7 shows a cross-sectional view through lines 7—7 of FIG. 6.

As shown best in FIGS. 3 and 7, cylindrical tube 8 is shown having a front end section 60 having a reduced diameter section 62 and a rear section 64. The rear section includes a peripheral groove 66 and shoulder at 68. Cylindrical tube 8 further includes inner diameter at 70.

As also shown best in FIG. 7, jack assembly 2 includes an insulator member 74 having a front cylindrical section 76, profiled to be received within the diameter 70, and a rear rectangular section 78 for abutting a rear edge of rear section 64 of cylindrical tube 8. Rear rectangular section 74 includes a transverse slot formed by parallel and opposed surfaces 80 (only one of which surface can be seen in FIG. 7, due to the cross-sectional view). The slot formed by parallel and opposed surfaces 80 transitions into terminal receiving opening 82, which projects forwardly into the insulator member 74 opening into a forward recess section 84.

As also shown in FIG. 7, terminal 10 is shown having elongate pin portion 90 positioned within passageway 82, and with a right-angled portion 92, which defines a printed circuit board receiving terminal, as is known to those skilled in the art. As shown in FIG. 7, portion 92 is orthogonally formed so as to be received in the slot, which is defined by parallel and opposed surfaces 80.

Finally, with respect to FIG. 3, forward sleeves 94, 96 can also be positioned on the forward end of cylindrical tubes 8 of varying diameters and/or lengths for polarization.

With the components described above, the jack assembly will now be described. As shown best in FIG. 7, pin terminal 90 is first inserted into passageway 82, whereupon front cylindrical section 76 of insulator member 74 may be positioned within diameter 70 of cylindrical tube 8. Ground shell 4 may now be slidably received over cylindrical tube 8, with partial cylindrical portion 30 encompassing cylindrical tube member 8. A forward edge of partial cylindrical section 30 can be crimped to form an indentation 100, which become encapsulated within peripheral groove 66 (FIG. 7) to retain the ground shell 4 and cylindrical tube 8 in the longitudinal sense. As shown in the jack subassemblies comprised of the ground shell 4 and cylindrical tubes 8 can be received into the drawn cylindrical shell portions 16 to the position shown in FIG. 7, whereby the outer shroud 6 can be held to the ground shell 4 in a number of ways, including an interference fit, a crimp, a solder, and other like means.

Advantageously, the design provides for a simplified assembly method for stamping and forming a connector assembly including a ground shell, such as that shown at item 4 herein. In previous prior art versions, in particular where the ground shell is drawn, the connector assembly cannot use pre-plated stock, as the drawing process ruins the pre-plated material. Thus, when pre-plated stock is drawn, and then post-plated, the process is significantly more expensive.

Figure 9:
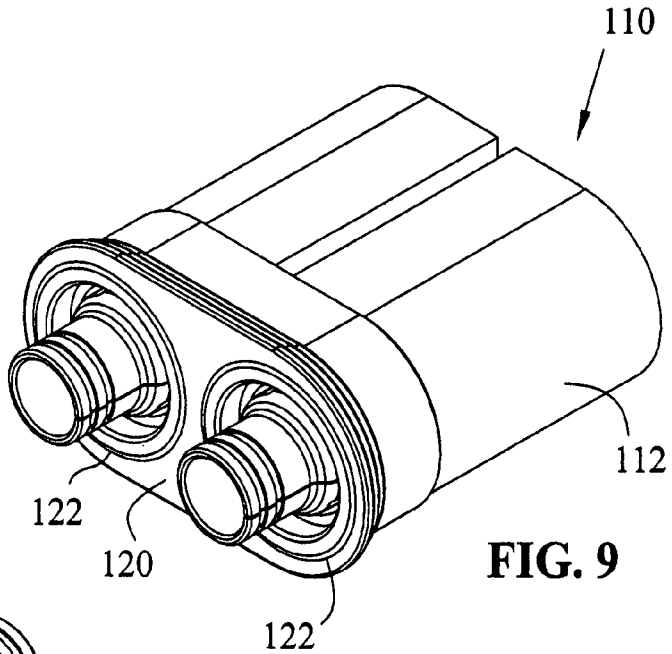
FIG. 9 is a rear perspective view of the connector shown in FIG. 8.
Figure 8:
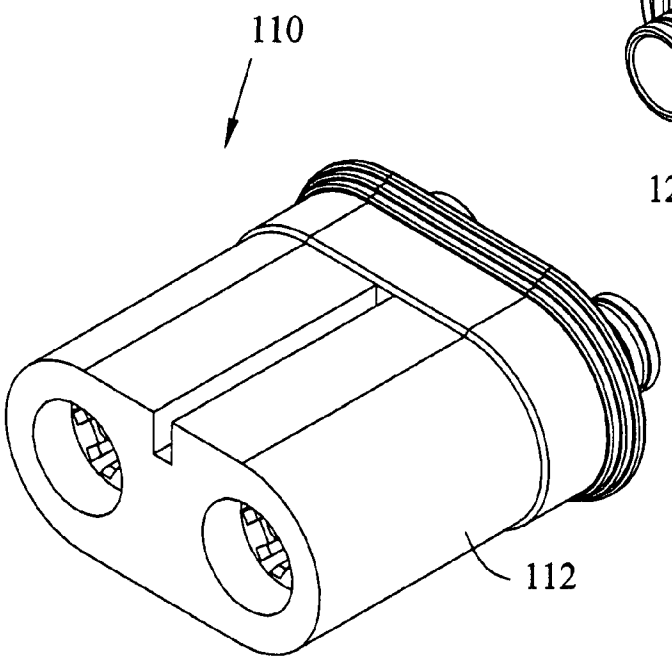
FIG. 8 shows a front perspective view of a mating connector for interconnection with the jack assembly of FIGS. 1 through 7.
Figure 10:
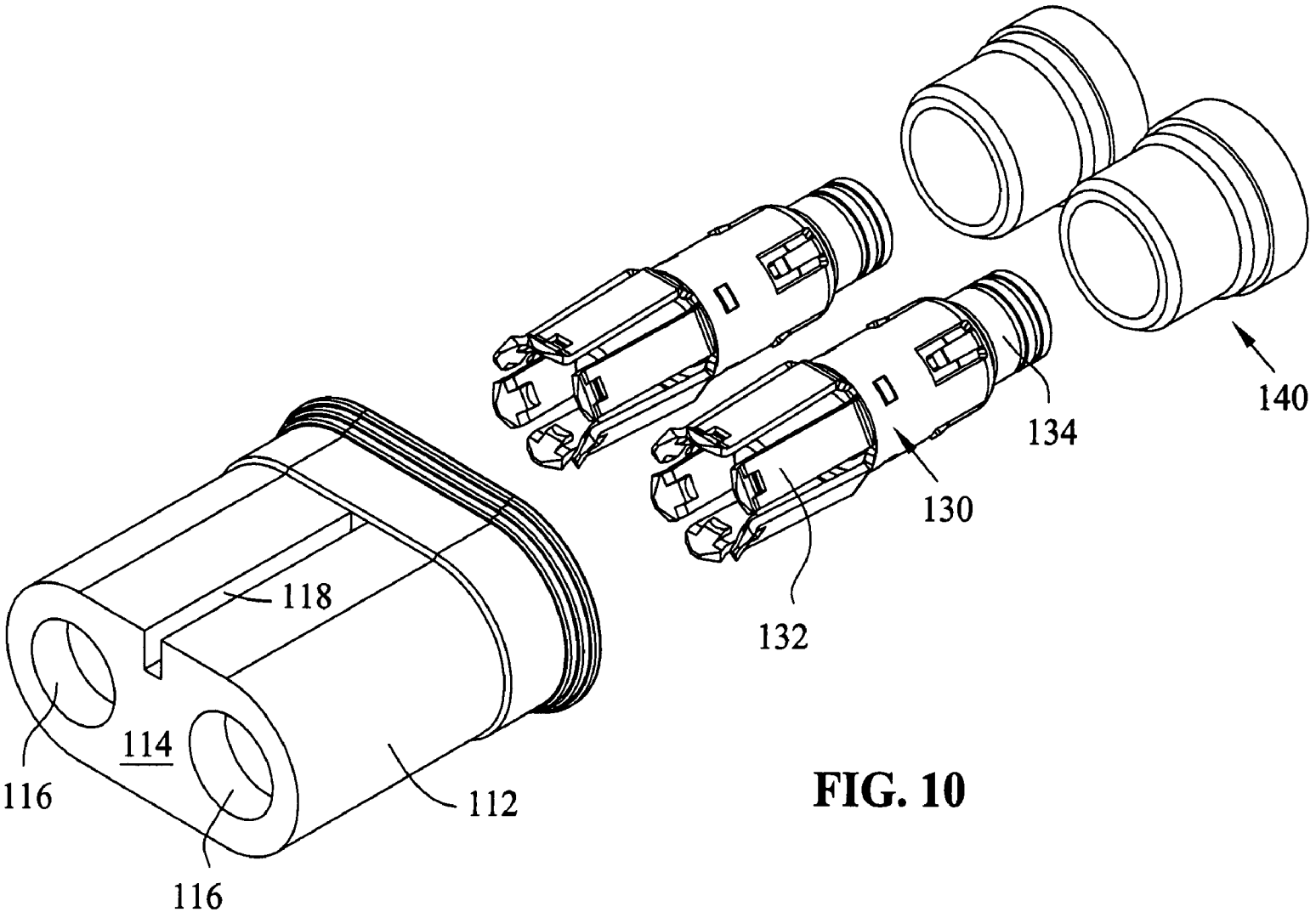
FIG. 10 is an exploded view of the connector assembly shown in FIG. 8.
Figure 11:
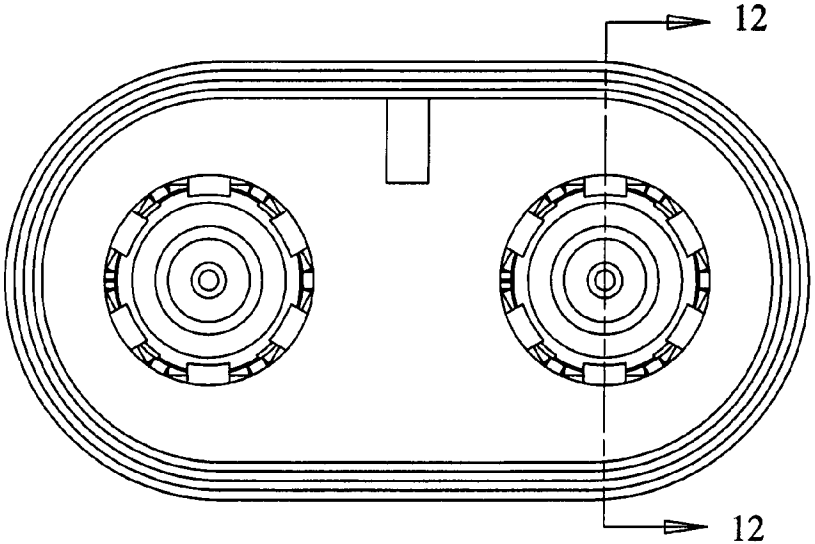
FIG. 11 shows a front plan view of the connector shown in FIG. 8.
Figure 12:
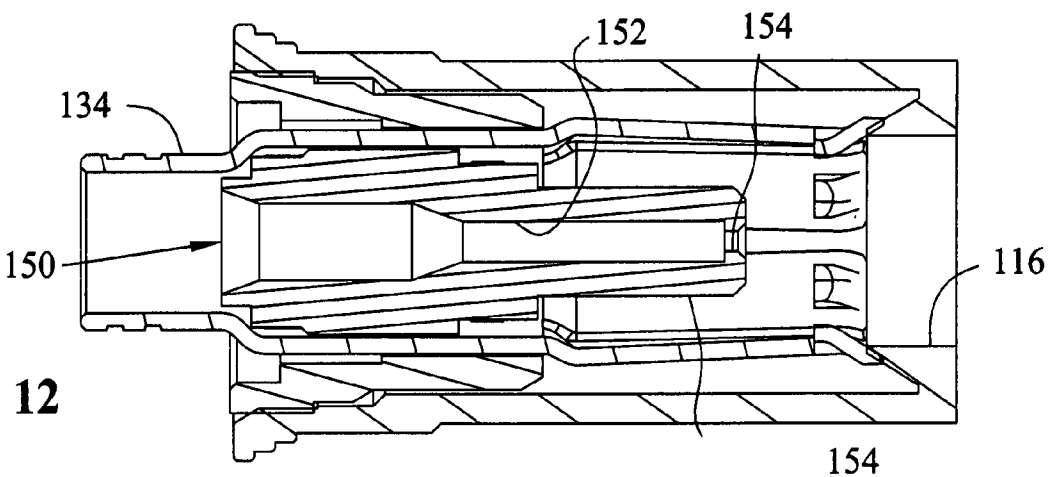
FIG. 12 is a cross-sectional view through lines 12—12 of FIG. 11.

With respect now to FIGS. 8 through 12, a mating socket connector 110 will be described in greater detail. FIGS. 8 and 9 show opposite perspective views of the assembled connector as including an insulative housing 112, shield contacts 130 (FIG. 10) and retaining plugs 140 (FIG. 10). As shown in FIG. 10, housing 112 includes a front face 114 having openings 116, central slot 118 and a rear face 120 (FIG. 9) having openings at 122. Shield contacts 130 include individual contact portions 132 and a rear crimping area 134. An inner insulative housing 150 (FIG. 12) includes a terminal passageway at 152 and a necked-down section 154. It should be appreciated that a female contact can be positioned in opening 152 adjacent to opening 156, whereby pin portion 91 can be received from the opposite side through opening 156 into contact with the female contact in passageway 152. Further, necked-down section 154 can be received within recessed section 84 (FIG. 7), while at the same time shield contacts 132 can overlappingly engage cylindrical tube 8 in electrical contact therewith.

What is claimed is:

1. A shielded jack assembly, comprising:

an elongate insulator member having a central elongate pin receiving passageway, and a rear slot intersecting said passageway at least to an outer surface of said insulator member, and a recess portion adjacent a front end of said insulator;

an electrical pin, having an elongate portion positioned insulatively in said passageway, and having an orthogonally arranged printed circuit board tine, which extends in said rear slot portion and extends downwardly beyond said outer surface of said insulator, and said pin having a mating portion extending into said recess portion, where said pin is exposed;

an elongate seamless shielded tube extending from a position adjacent said front end of said insulator, and rearwardly, at least partially along the length of said insulator member, a stamped and formed metallic ground shell, having an outer body portion conforming to an exterior contour of said shielded tube, sidewall portions extending downwardly therefrom with integrally formed printed circuit board portions, and a rear plate portion hingedly connected to said outer body portion, and folded downwardly to enclose an end opening; and an outer shroud portion surrounding said shielded tube and a portion of said metallic ground shell, forming an outer shielding.

2. The shielded jack assembly of claim 1, wherein said insulator member, shielded tube, and said outer body portion of said ground shell are cylindrical in cross section.

3. The shielded jack assembly of claim 1, wherein said shielded tube and said ground shell are fixed together along their length.

4. The shielded jack assembly of claim 1, wherein said outer shroud portion is stamped and formed to define a longitudinal overlapping seam.

5. The shielded jack assembly of claim 4, comprising a plurality of assembled insulator members, pins, shielded tubes, and ground shells, said shroud including a rear wall having a like plurality of openings therethrough for receiving said plurality of assembled insulator members, pins, shielded tubes, and ground shells.

6. The shielded jack assembly of claim 5, wherein said overlapping seam extends downwardly and inwardly, and intermediate said plurality of assembled insulator members, pins, shielded tubes, and ground shells, and defines an alignment rib for a mating connector.

7. The shielded jack assembly of claim 6, wherein said rear plate of said ground shell and said outer shroud member have a tab extending downwardly therefrom profiled for soldering to a printed circuit board.

8. A shielded jack assembly, comprising:

an elongate insulator member having a central elongate pin receiving passageway, and a rear slot intersecting said passageway at least to an outer surface of said insulator member, and a recess portion adjacent a front end of said insulator;

an electrical pin, having an elongate portion positioned insulatively in said passageway, and having an orthogonally arranged printed circuit board tine, which extends in said rear slot portion and extends downwardly beyond said outer surface of said insulator, and said pin having a mating portion extending into said recess portion, where said pin is exposed;

an elongate seamless shielded tube extending from a position adjacent said front end of said insulator, and rearwardly, at least partially along the length of said insulator member, said tube including a peripheral undercut, and a stamped and formed metallic ground shell, having an outer body portion conforming to an exterior contour of said shielded tube, sidewall portions extending downwardly therefrom with integrally formed printed circuit board portions, and a rear plate portion hingedly connected to said outer body portion, and folded downwardly to enclose an end opening, said ground shell being crimped around said tube with a section of said outer body portion extending into said undercut.

9. A shielded jack assembly, comprising:

an elongate cylindrical insulator member having a central elongate pin receiving passageway, and a rear slot intersecting said passageway at least to an outer surface of said insulator member, and a recess portion adjacent a front end of said insulator;

an electrical pin, having an elongate portion positioned insulatively in said passageway, and having an orthogonally arranged printed circuit board tine, which extends in said rear slot portion and extends downwardly beyond said outer surface of said insulator, and said pin having a mating portion extending into said recess portion, where said pin is exposed;

an elongate cylindrical seamless shielded tube extending from a position adjacent said front end of said insulator, and rearwardly, at least partially along the length of said insulator member;

a stamped and formed metallic ground shell, having an outer body portion conforming to, and crimped to, an exterior contour of said shielded tube, sidewall portions extending downwardly therefrom with integrally formed printed circuit board portions; and an outer shroud portion surrounding said shielded tube and a portion of said metallic ground shell, forming an outer shielding.

10. The shielded jack assembly of claim 9, further comprising a rear plate portion hingedly connected to said outer body portion, and folded downwardly to enclose an end opening.

11. A shielded jack assembly, comprising:

an elongate cylindrical insulator member having a central elongate pin receiving passageway, and a rear slot intersecting said passageway at least to an outer surface of said insulator member, and a recess portion adjacent a front end of said insulator;

an electrical pin, having an elongate portion positioned insulatively in said passageway, and having an orthogonally arranged printed circuit board tine, which extends in said rear slot portion and extends downwardly beyond said outer surface of said insulator, and said pin having a mating portion extending into said recess portion, where said pin is exposed;

an elongate cylindrical seamless shielded tube extending from a position adjacent said front end of said insulator, and rearwardly, at least partially along the length of said insulator member, said tube including a peripheral undercut;

a stamped and formed metallic ground shell, having an outer body portion conforming to, and crimped to, an exterior contour of said shielded tube, sidewall portions extending downwardly therefrom with integrally formed printed circuit board portions, said ground shell being crimped around said tube with a section of said outer body portion extending into said undercut; and an outer shroud portion surrounding said shielded tube, forming an outer shielding.

12. The shielded jack assembly of claim 11, wherein said outer shroud portion is stamped and formed to define a longitudinal overlapping seam.

13. The shielded jack assembly of claim 12, comprising a plurality of assembled insulator members, pins, shielded tubes, and ground shells, said shroud including a rear wall having a like plurality of openings therethrough for receiving said plurality of assembled insulator members, pins, shielded tubes, and ground shells.

14. The shielded jack assembly of claim 13, wherein said overlapping seam extends downwardly and inwardly, and intermediate said plurality of assembled insulator members, pins, shielded tubes, and ground shells, and defines an alignment rib for a mating connector.

15. The shielded jack assembly of claim 14, wherein said rear plate of said ground shell and said outer shroud member have a tab extending downwardly therefrom profiled for soldering to a printed circuit board.

16. A method of forming a shielded jack assembly, comprising the steps of:

providing an elongate insulator member having a central elongate pin receiving passageway, and a rear slot intersecting said passageway at least to an outer surface of said insulator member, and a recess portion adjacent a front end of said insulator;

providing an electrical pin, with an elongate portion, and forming an orthogonally arranged printed circuit board tine;

inserting said pin into said insulator member such that said elongate portion is positioned insulatively in said passageway, and such that said printed circuit board tine extends in said rear slot portion and extends downwardly beyond said outer surface of said insulator, and said pin having a mating portion extending into said recess portion, where said pin is exposed;

providing an elongate seamless shielded tube extending from a position adjacent said front end of said insulator, and rearwardly, at least partially along the length of said insulator member, stamping and forming a metallic ground shell to comprise an outer body portion conforming to an exterior contour of said shielded tube, sidewall portions extending downwardly therefrom with integrally formed printed circuit board portions, and a rear plate portion hingedly connected to said outer body portion, and folding said rear plate portion downwardly to enclose an end opening; and stamping and forming an outer shroud portion, placing said outer shroud portion in a surrounding relation with said shielded tube and a portion of said metallic ground shell, and fixing said outer shroud portion, metallic ground shell and shielded tube together.

17. The shielded jack assembly of claim 16, further comprising the step of providing a plurality of assembled insulator members, pins, shielded tubes, and ground shells, with said shroud including a rear wall having a like plurality of openings therethrough for receiving said plurality of assembled insulator members, pins, shielded tubes, and ground shells.

18. A method of forming a shielded jack assembly, comprising the steps of:

providing an elongate insulator member having a central elongate pin receiving passageway, and a rear slot intersecting said passageway at least to an outer surface of said insulator member, and a recess portion adjacent a front end of said insulator;

providing an electrical pin, with an elongate portion, and forming an orthogonally arranged printed circuit board tine;

inserting said pin into said insulator member such that said elongate portion is positioned insulatively in said passageway, and such that said printed circuit board tine extends in said rear slot portion and extends downwardly beyond said outer surface of said insulator, and said pin having a mating portion extending into said recess portion, where said pin is exposed;

providing an elongate seamless shielded tube extending from a position adjacent said front end of said insulator, and rearwardly, at least partially along the length of said insulator member, said shielded tube being provided with a peripheral undercut, and stamping and forming a metallic ground shell to comprise an outer body portion conforming to an exterior contour of said shielded tube, sidewall portions extending downwardly therefrom with integrally formed printed circuit board portions, a rear plate portion hingedly connected to said outer body portion, and folding said rear plate portion downwardly to enclose an end opening, and said ground shell crimped around said tube with a section of said outer body portion extending into said undercut.

* * * * *